United States Patent [19]

Field et al.

[11] Patent Number: 5,044,894

[45] Date of Patent: Sep. 3, 1991

[54] CAPACITY VOLUME RATIO CONTROL FOR TWIN SCREW COMPRESSORS

[75] Inventors: Michael G. Field, Fabius; David N. Shaw, Manlius, both of N.Y.

[73] Assignee: Carrier Corporation, Syracuse, N.Y.

[21] Appl. No.: 620,116

[22] Filed: Nov. 30, 1990

[51] Int. Cl.[5] ..... F04B 49/00; F01C 1/16

[52] U.S. Cl. ..... 417/310; 418/201.2

[58] Field of Search ..... 417/310; 418/201.2

[56] References Cited

U.S. PATENT DOCUMENTS

| | | | |
|---|---|---|---|
| 4,516,914 | 5/1985 | Murphy et al. | 417/310 |
| 4,519,748 | 5/1985 | Murphy et al. | 418/201.2 |
| 4,678,406 | 7/1987 | Pillis et al. | 417/310 |

*Primary Examiner*—Leonard E. Smith
*Assistant Examiner*—Alfred Basichas

[57] ABSTRACT

The slide valve and the slide stop of a screw compressor are infinitely positionable over their range of movement. Movement is achieved by fluid pressure acting across an actuating piston in combination with the fluid pressure acting on the slide valve and slide stop plus a spring bias.

5 Claims, 8 Drawing Sheets

CAPACITY VOLUME RATIO CONTROL FOR TWIN SCREW COMPRESSORS

BACKGROUND OF THE INVENTION

In twin screw compressors, the bores for the two rotors overlap such that the bores make a single cavity having the outline of a figure eight with cusps located at the waist portion of the figure eight. Conventionally, one of the cusps is made up of a slide valve and a slide stop. The slide stop changes the volume ratio of the device in accordance with its position while the position of the slide valve controls the capacity of the device. U.S. Pat. No. 4,678,406 is exemplary of the prior art devices employing a slide valve and slide stop.

SUMMARY OF THE INVENTION

The slide valve and slide stop are each positioned by fluid pressure acting across an actuating piston in combination with the fluid pressure acting on the slide valve and slide stop and a spring bias. The actuating pistons for the slide valve and slide stop are in axially spaced and fluid pressure isolated portions of a common bore and have concentric, coaxial rods connected to the slide valve and slide stop, respectively. Discharge pressure oil from the oil separator is selectively supplied to and drained from the controlled pressure side of the slide valve actuating piston while the other side of the slide valve actuating piston is continually drained to suction (or to first closed lobe pressure which is just higher than suction pressure) and this unloads and loads the compressor. The high pressure oil is supplied and controlled by a solenoid valve to unload the compressor. A second solenoid valve fluidly connects the controlled pressure side of the actuating piston to suction pressure and is opened when the compressor is required to load up again. By opening and closing these two solenoid valves, the slide valve actuating piston may be infinitely positioned as well as the slide valve which is connected thereto.

Similarly, the slide stop actuating piston and attached stop are infinitely positioned by a second pair of solenoid valves. This allows the volume ratio of the compressor to be controlled over its full range. Upon shutdown, the solenoid connecting the slide valve actuating piston to suction will backfeed which allows the unloading spring to separate the movable slide stop and the slide valve thereby assuring the unloading of the compressor when it is shutoff. Alternatively, or additionally, a check valve can be located in the slide valve actuating piston.

It is an object of this invention to provide a capacity and volume ratio control for a twin screw compressor.

It is another object of this invention to assure the unloading of a twin screw compressor when it is shutoff.

It is a further object of this invention to provide a simple and reliable apparatus for capacity reduction, volume ratio control and for providing for unloading during shutdown. These objects, and others as will become apparent hereinafter, are accomplished by the present invention.

Basically, the actuating pistons for the slide valve and slide stop of a twin screw compressor are axially spaced and fluid pressure isolated in a common bore and have concentric rods respectively connected to the slide valve and slide stop. The slide valve and slide stop can be individually infinitely positioned within their range of movement. An unloading spring acts on the movable slide stop and the slide valve to cause their separation at shutoff to assure unloading of the compressor.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 4:
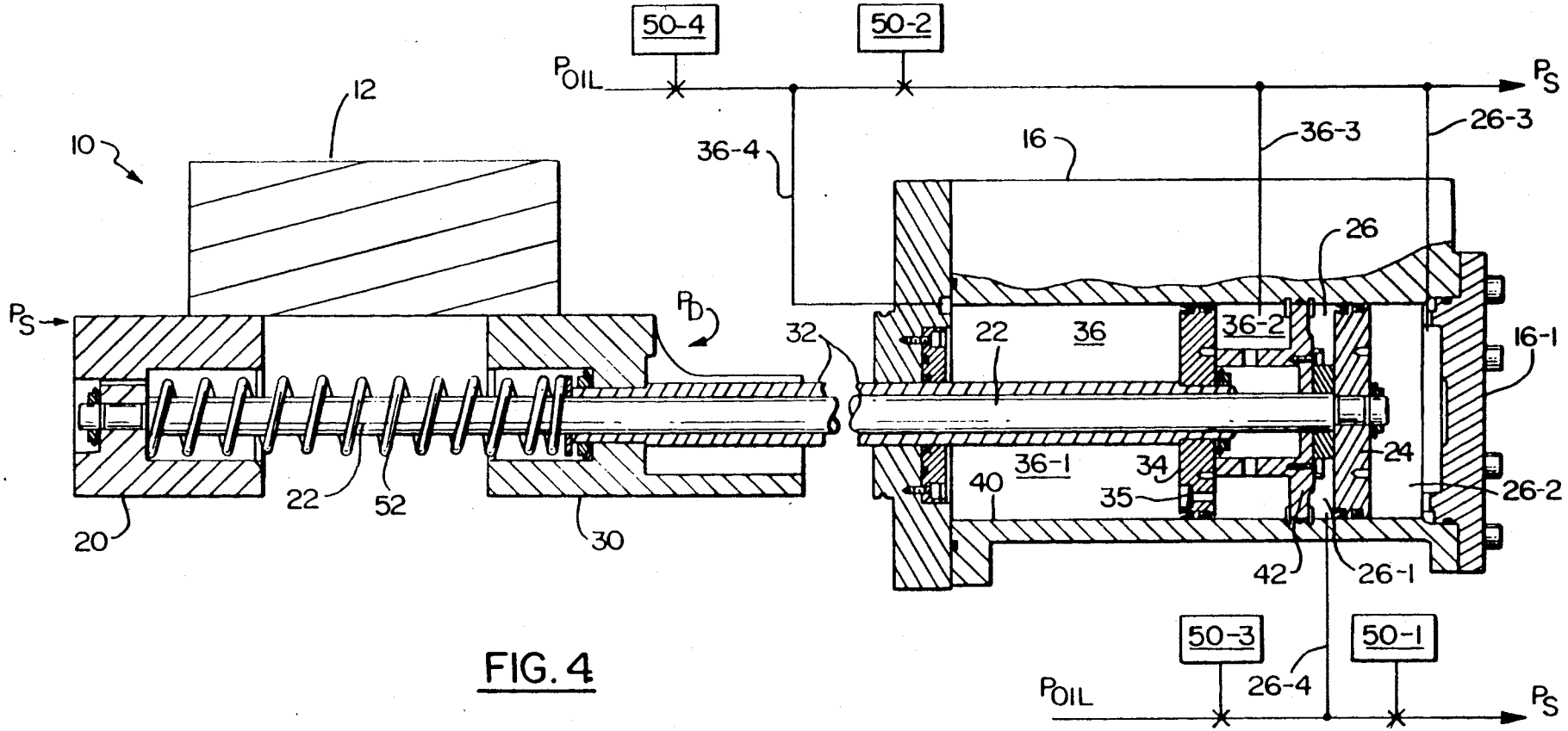
FIGS. 4–6 correspond to FIGS. 1–3, respectively, but the screw compressor is in a low $V_i$ mode.
Figure 5:
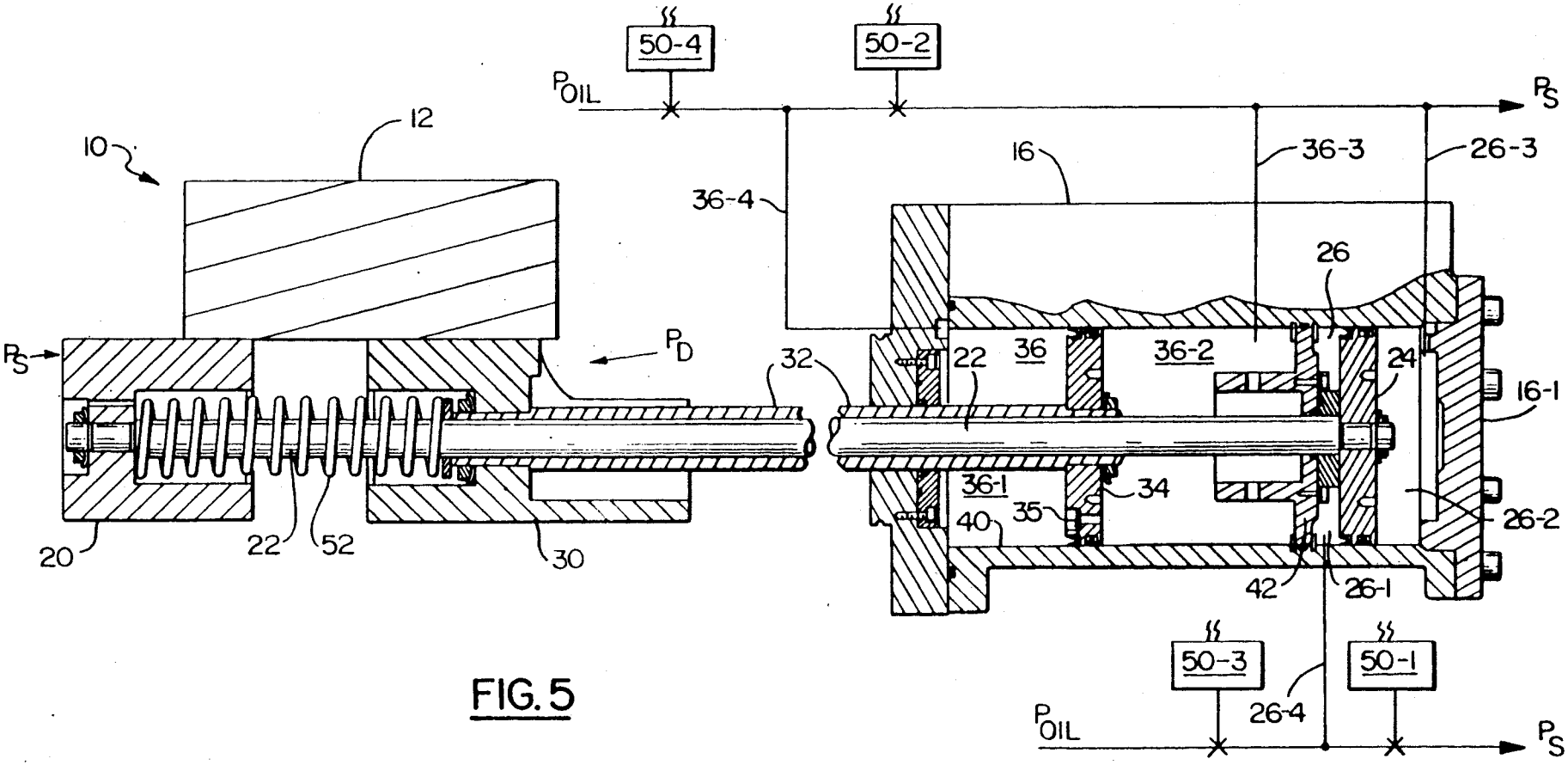
Figure 6:
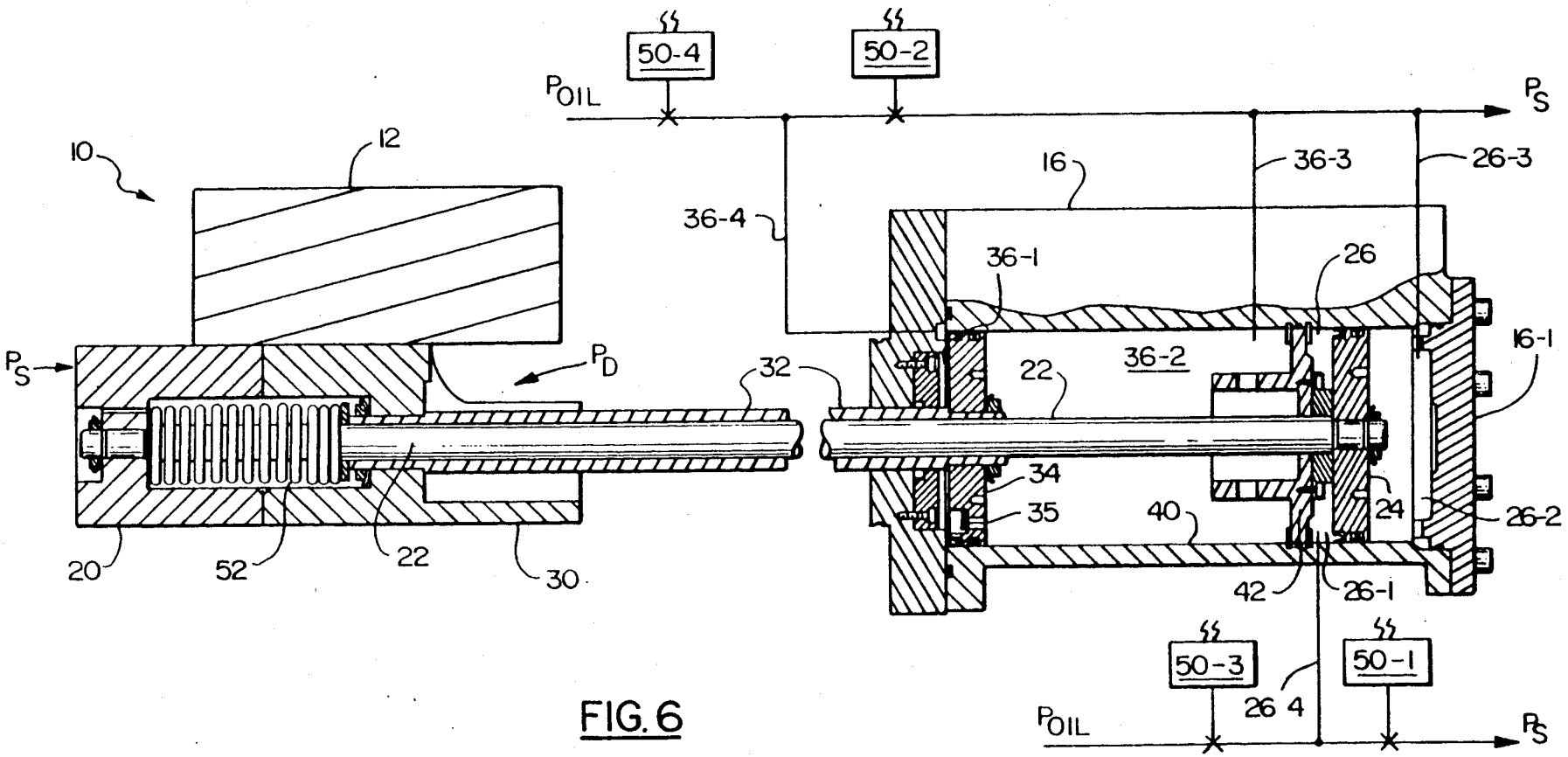

In FIGS. 4–6, the numeral 12 generally designates the male and female rotors of a twin screw compressor 10. Rotors 12 are in a figure eight shaped bore in a housing (not illustrated). Slide stop 20 and slide valve 30 are located in the housing so as to define the cusp portion of the waist of the figure eight shaped bore. Slide stop 20 is connected to slide stop actuating piston 24 via rod 22. Slide valve 30 is connected to slide valve actuating piston 34 via annular rod 32. Rod 32 is concentric with and surrounds rod 22 so as to permit relative movement between rods 22 and 32 as well as to permit the possibility of fluid flow therebetween.

Figure 9:
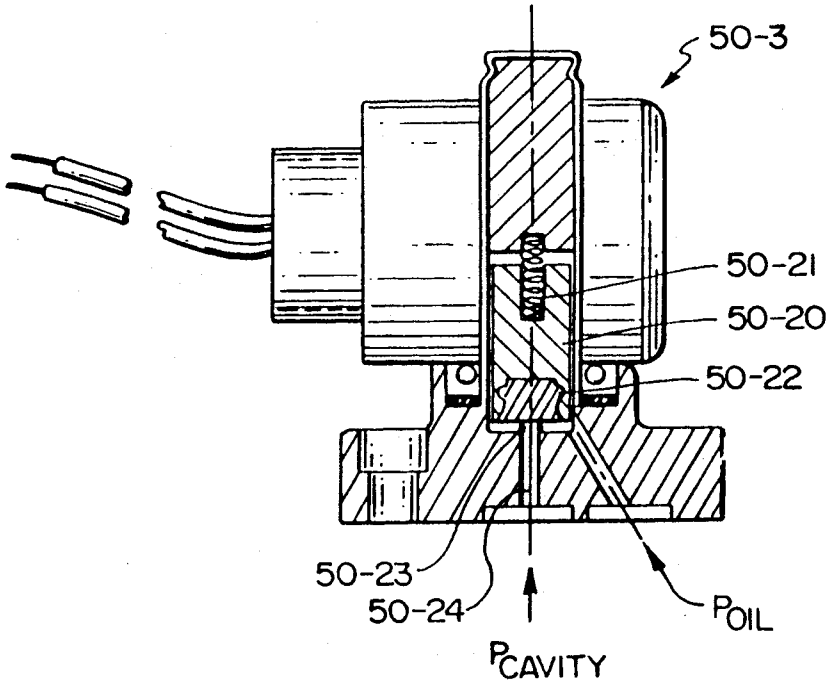
FIG. 9 is a partially sectioned view of a second solenoid.

Bore 40 in control housing 16 is divided into two piston chambers by member 42 which serves as a guide for rod 22 as well as providing a stop for pistons 24 and 34. Specifically, pistons 24 and 34 are reciprocatably located in piston chambers 26 and 36, respectively, which are formed by bore 40 and member 42. In turn, piston 24 divides chamber 26 into chambers 26-1 and 26-2 and piston 34 divides chamber 36 into chambers 36-1 and 36-2. Suction or first closed lobe pressure is always communicated to chambers 26-2 and 36-2 via lines 26-3 and 36-3, respectively, as well as being selectively communicated to chamber 26-1 via line 26-4 under the control of solenoid valve 50-1 and to chamber 36-1 via line 36-4 under the control of solenoid valve 50-2. Discharge pressure is also selectively communicated to chambers 26-1 and 36-1 under the control of solenoid valves 50-3 and 50-4, respectively. Solenoid valves 50-1 to 4 are shown in more detail in FIGS. 8 and 9 where solenoids 50-2 and 50-3 are specifically illustrated but solenoids 50-1 and 50-4 would be identical to solenoids 50-2 and 50-3, respectively, and the only differences between the solenoids are in their pressure connections.

Figure 1:
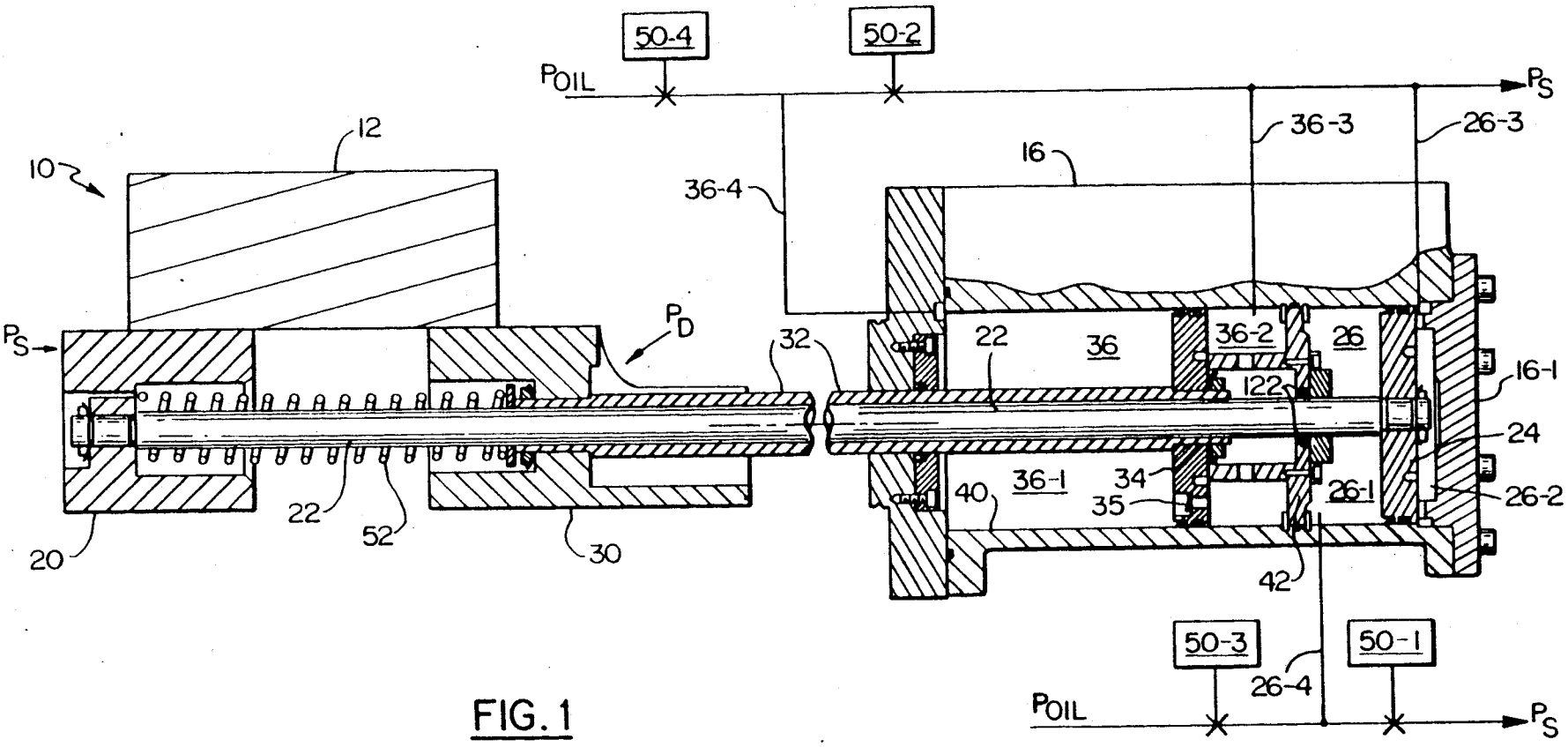
FIG. 1 is a partial schematic sectional view of a screw compressor in a high volumetric ratio ($V_i$) mode but in the unloaded position.
Figure 8:
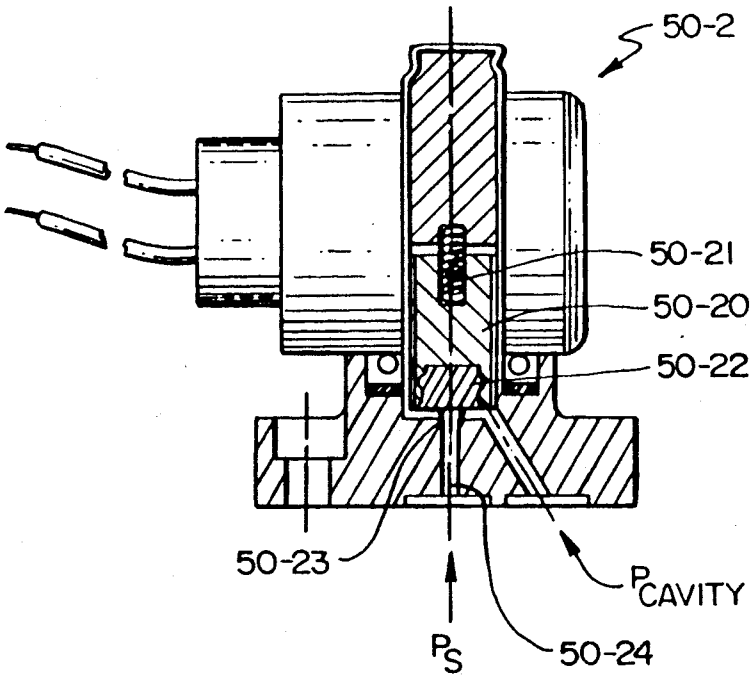
FIG. 8 is a partially sectioned view of a first solenoid.

Referring specifically to FIG. 1, the compressor 10 is illustrated as being in the unloaded high $V_i$ mode. In the high $V_i$ condition, solenoid valve 50-3 is open and solenoid 50-1 is closed so that oil at discharge pressure, $P_{oil}$, is supplied from the oil separator (not illustrated) to chamber 26-1 and acts on piston 24 to move piston 24 to its extreme right position, in FIGS. 1–3, in engagement with cover 16-1 in concert with the suction pressure acting on slide stop 20 and in opposition to suction pressure in chamber 26-2 acting on piston 24 and the spring bias acting against slide stop 20. In the unloaded condition of FIG. 1, solenoid valve 50-4 is open and solenoid valve 50-2 is closed and suction or first lobe pressure, $P_s$, is always supplied to chamber 36-2. Upon shutdown of compressor 10 in any position, solenoids 50-1 through 4 are no longer electrically powered so that biasing closure of the valves is solely due to the weight of the valve plunger and a weak spring. Referring specifically to FIG. 8, valve plunger 50-20 of solenoid valve 50-2 is biased by weak spring 50-21 so that valve plunger insert 50-22 seats against seat 50-23 surrounding bore 50-24 which is in fluid communication with suction pressure, $P_s$. Thus, at shutdown of compressor 10, unless piston 34 is already in engagement with member 42, strong spring 52 will tend to move piston 34 into engagement with member 42. This will tend to make chambers 36-1 and 36-2 the suction and discharge sides, respectively, of a double acting piston. However, the reduction of pressure in chamber 36-1, $P_{cavity}$, is such that suction pressure acting on valve plunger 20 unseats insert 50-22 from seat 50-23 permitting suction pressure to backfeed through solenoid valve 50-2 via bore 50-24 and line 36-4 into chamber 36-1 to permit movement of piston 36. Alternatively, check valve 35 in piston 34 may be used to permit fluid pressure equalization on shutdown to permit the movement of piston 34 by spring 52. Since FIG. 1 represents the fully unloaded position, the suction pressure, $P_s$, will act on slide stop 20 in opposition to the bias of spring 52 and the discharge pressure, $P_D$, will act on slide valve 30 in opposition to the bias of spring 52. In the unloaded condition there will be a very small volumetric flow through compressor 10 as will be noted from the short coextensive length of rotors 12 and slide valve 30 in FIG. 1.

Figure 2:
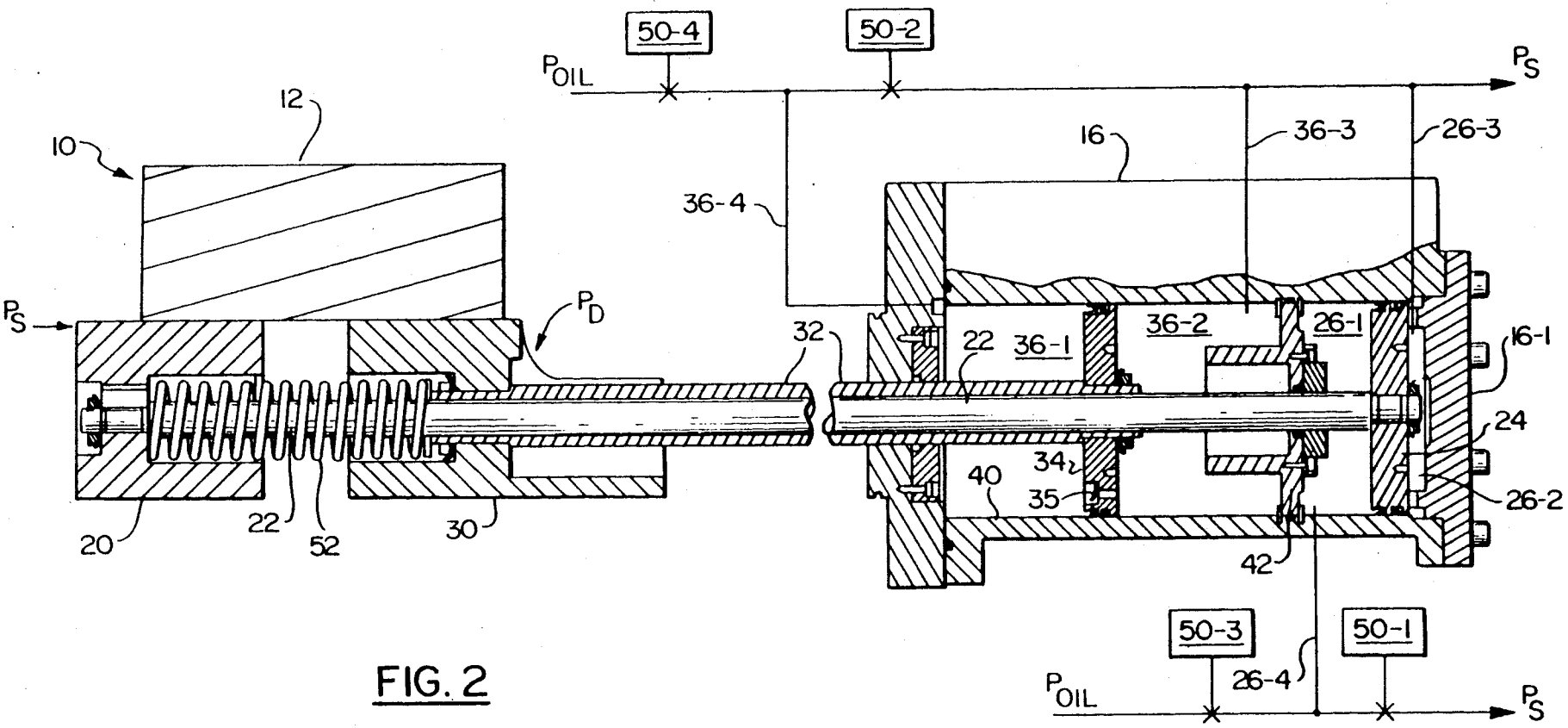
FIG. 2 is a view similar to FIG. 1 but in an intermediate or partially unloaded position.
Figure 3:
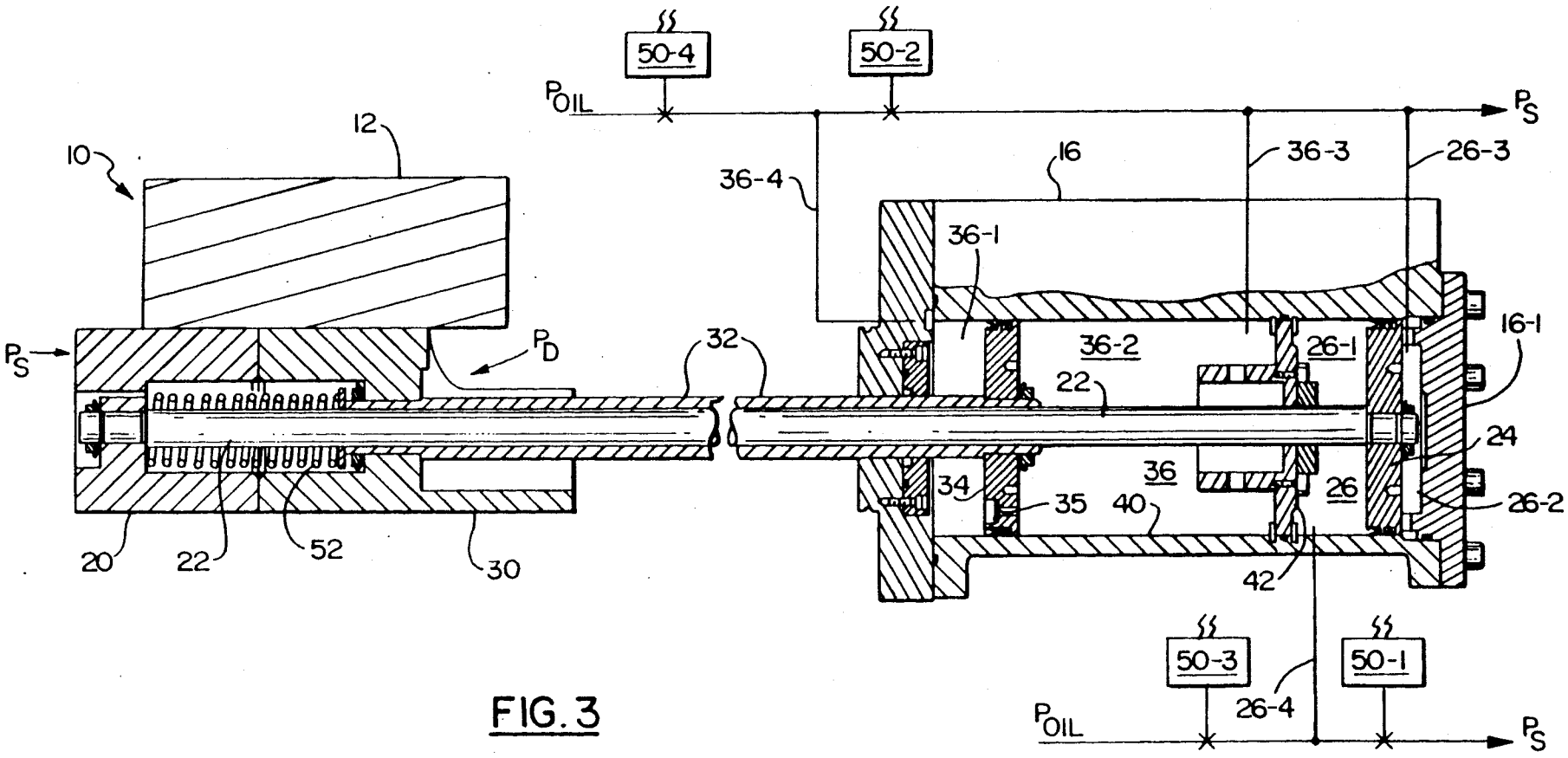
FIG. 3 is a view similar to FIG. 1 but in a fully loaded position and at the highest volumetric ratio.

Referring now to FIG. 2, it will be noted that it differs from FIGS. 1 and 3, which represent the extreme positions, only in the positioning of piston 34 and slide valve 30 as well as the compression of spring 52. Leftward movement is achieved by closing solenoid 50-4 and opening solenoid 50-2 for an appropriate time to achieve the desired leftward movement of piston 34 and slide valve 30 due to the action of the discharge pressure, $P_D$, on slide valve 30 in opposition to the bias of both spring 52 and suction pressure on the left side of slide valve 30. Rightward movement is achieved by closing solenoid 50-2 and opening solenoid 50-4 for an appropriate time to achieve the desired movement due to the bias of spring 52 and the pressure differential across piston 34. The relative degree of opening of valves 50-2 and 50-4 can be regulated to achieve the desired positioning of piston 34 and slide valve 30.

FIG. 3 represents the fully loaded high $V_i$ position where slide stop 20 and slide valve 30 coact to form a continuous engagement with rotors 12. To achieve the FIG. 3 position, solenoid 50-4 is closed and solenoid 50-2 is open so that chambers 36-1 and 36-2 are at $P_s$ and the discharge pressure acting on slide valve 30 overcomes the bias of spring 52 acting on slide valve 30 and moves slide valve 30 to the FIG. 3 position.

Referring now to FIG. 4, and comparing it to FIG. 1, the only change made is the shutting of solenoid valve 50-3 and the opening of solenoid valve 50-1. This results in chambers 26-1 and 26-2 being at suction or first lobe pressure. The biasing force of spring 52 against the suction pressure acting on slide stop 20 results in a net force on integral piston 24 to the left. The consequence is a wider separation of slide stop 20 and slide valve 30 in the FIG. 4 mode as compared to the FIG. 1 mode due to the movement of slide stop 20 and this results in a slight reduction in the precompression work.

FIG. 5 represents an intermediate slide valve position between that of FIGS. 4 and 6. Movement of piston 34 and slide valve 30 to the left is achieved by closing valve 50-4 and opening valve 50-2 for a sufficient time for the discharge pressure acting on the discharge side of slide valve 30 to produce the desired movement in opposition to the bias of spring 52. To achieve movement of piston 34 and slide valve 30 to the right, valve 50-2 is closed and valve 50-4 is opened for a sufficient time to achieve the desired movement. The relative degree of opening of valves 50-2 and 50-4 can be regulated to pressurize chamber 36-1 to the degree necessary to achieve the desired positioning of piston 34 and slide valve 30.

FIG. 6 represents the fully loaded low $V_i$ position where slide stop 20 and slide valve 30 coact to form a continuous engagement with rotors 12. In comparing FIGS. 3 and 6 it will be noted that the slide stop 20 and slide valve 30 have a longer coextensive length with rotors 12 in the FIG. 3 configuration. To achieve the FIG. 6 position, valve 50-4 is closed and valve 50-2 is opened whereby the discharge pressure acting on slide valve 30 will shift piston 34 and slide valve 30 to the FIG. 6 position against the bias of spring 52.

Figure 7:
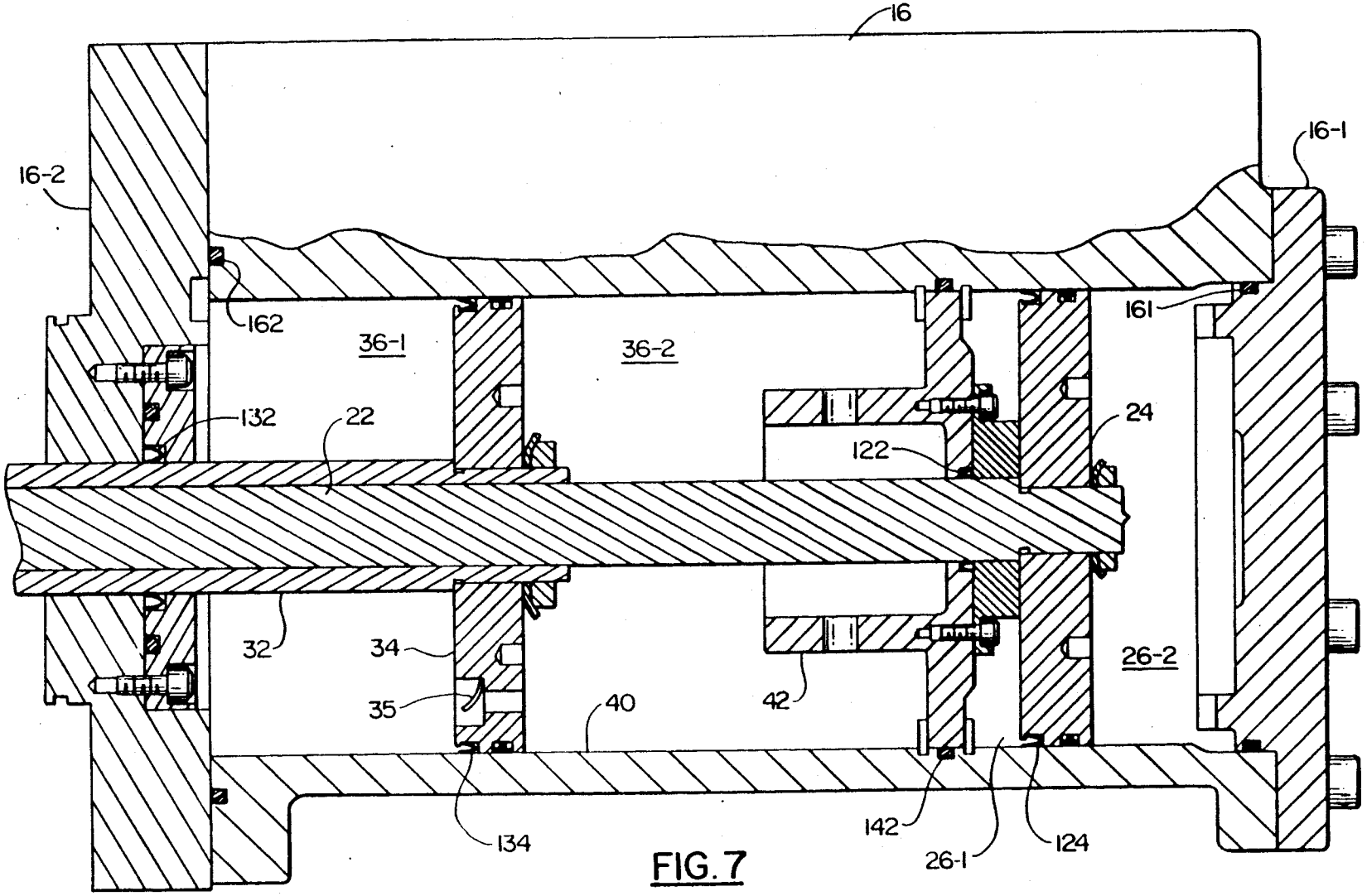
FIG. 7 is an enlarged view of the control apparatus showing the sealing structures.

Referring now to FIG. 7, a larger scale view of the control housing 16 is presented. It will be noted that O-ring seals 161 and 162 provide a seal between housing 16 and covers 16-1 and 16-2, respectively. Pistons 24 and 34 are sealed with respect to bore 40 by chevron seals 124 and 134, respectively. O-ring seal 142 provides a seal between member 42 and bore 40. Chevron seal 122 provides a seal between rod 22 and member 42 and chevron seal 132 provides a seal between rod 32 and cover 16-2. Chevron seal 132 seals chamber 36-1 from discharge pressure, $P_D$, so that the desired pressure is present in chamber 36-1 as contrasted to conventional designs where chamber 36-1 is open and exposed to $P_D$. Thus, piston 34 is isolated from discharge manifold variations in discharge pressure which could result in unwanted vibration of the piston 34. As noted above, a leakage path exists between rods 22 and 32. Check valve 35 additionally/alternatively provides pressure equalization across piston 34 to permit spring 52 to achieve the FIG. 4 position upon shutdown.

Upon a normal system start, the final system controlled fluid temperature is usually higher than the system set point. Also when the controlled fluid temperature falls below the set point, compressor unloading is called for. If chamber 36-1 was continuously exposed to discharge pressure, as in conventional designs, it would take a long time to move fluid from chamber 36-2 due to the relatively low volumetric flow rate that can take place through line 36-3 and the solenoid valve or other valve required in such a configuration when unloading is called for. As a result, the final system controlled fluid temperature can become too low causing full unloading to take place with conventional designs resulting in large oscillations on system pulldown. In contrast, in the present invention at the fully loaded position of FIGS. 3 and 6, $P_S$ is present in chambers 36-1 and 36-2 and thus makes it very easy to raise the pressure in chamber 36-1 to unload the compressor 10 without requiring a lengthy bleed down. Thus, the present invention provides an easy unloading during pulldown.

Although a preferred embodiment of the present invention has been illustrated and described, other modification will occur to those skilled in the art. For example, first lobe pressure, which is just above suction pressure, may be used instead of suction pressure. It is therefore intended that the present invention is to be limited only by the scope of the appended claims.

What is claimed is:

1. In a screw compressor having rotors, a slide valve exposed to discharge pressure and movable slide stop exposed to suction pressure, slide valve and slide stop positioning means comprising:

a control housing means having a bore therein;

dividing means for dividing said bore into first and second piston chambers;

a first piston means reciprocatably located in and dividing said first chamber into two cavities and having an annular rod connecting said first piston means and said slide valve and extending through said control housing means in a sealingly guided relationship;

a second piston means reciprocatably located in and dividing said second chamber into two cavities and having an inner rod connecting said second piston means on said slide stop and serially extending through said dividing means in a sealingly guided relationship, through said annular rod and said slide valve;

spring means surrounding said inner rod and acting against said slide valve and said slide stop so as to tend to separate said slide valve and said slide stop; and fluid pressure means connected to said two cavities in both said first and second chambers for selectively moving said first and second piston means and thereby said slide valve and slide stop.

2. The slide valve and slide stop positioning means of claim 1 wherein one cavity in each of said first and second chambers is always connected to suction pressure.

3. The slide valve and slide stop positioning means of claim 2 wherein a second cavity in each of said first and second chambers is selectively connected to suction pressure and discharge pressure.

4. The slide valve and slide stop positioning means of claim 1 wherein one cavity in each of said first and second chambers is selectively connected to suction pressure and discharge pressure.

5. The slide valve and slide stop positioning means of claim 1 wherein said fluid pressure means includes pressure equalizing means for equalizing pressure across said first piston means upon shutdown and said screw compressor whereby said spring means moves said slide valve to an unloaded position upon shutdown of said screw compressor.

* * * * *